US006135374A

United States Patent [19]

Hansen et al.

[11] Patent Number: 6,135,374

[45] Date of Patent: Oct. 24, 2000

[54] FOOD BY-PRODUCT PROCESSING APPARATUS

[75] Inventors: Kristin G. Hansen; Jeffrey A. Murray, both of Portland, Oreg.

[73] Assignee: Mursen Environmental, Inc., Portland, Oreg.

[21] Appl. No.: 09/415,386

[22] Filed: Oct. 8, 1999

[51] Int. Cl.[7] ..... B02C 18/42

[52] U.S. Cl. ..... 241/46.013; 241/46.104; 241/79; 241/100; 241/186.35; 241/DIG. 38

[58] Field of Search ..... 241/46.013, 46.014, 241/46.015, 46.016, 79, 100, 38, 41, 186.35, 185.5, DIG. 38

[56] References Cited

U.S. PATENT DOCUMENTS

| | | | |
|---|---|---|---|
| 2,150,984 | 3/1939 | Near et al. | 241/46.013 |
| 2,655,966 | 10/1953 | Russell | 241/46.013 |
| 4,081,146 | 3/1978 | Yagi | 241/152.2 |
| 5,123,600 | 6/1992 | Takenaka | 241/46.013 |
| 5,176,825 | 1/1993 | Hadjis et al. . | |
| 5,230,475 | 7/1993 | Gerner | 241/34 |
| 5,370,323 | 12/1994 | Narao | 241/46.013 |
| 5,744,006 | 4/1998 | Mausser et al. . | |
| 5,773,281 | 6/1998 | Ichikawa et al. . | |
| 5,830,323 | 11/1998 | Grimm . | |
| 5,906,793 | 5/1999 | Vezzani . | |
| 5,924,217 | 7/1999 | Peeters . | |
| 5,924,637 | 7/1999 | Niederholtmeyer | 241/186.35 |

*Primary Examiner*—John M. Husar
*Attorney, Agent, or Firm*—Marger Johnson & McCollom

[57] ABSTRACT

Apparatus and improvements thereto are disclosed for processing food by-products. The apparatus in accordance with the invention includes a frame; an upstream and a first downstream pair of opposed rollers mounted for rotation within the frame, at least one of the rollers being rotated by a rotary drive mechanism. The apparatus further includes opposed upper and lower conveyors advanced between the upstream and first downstream pairs of opposed rollers as the rollers rotate, with the lower conveyor providing along opposite edges thereof for liquid run-off. The apparatus further includes an input region adjacent the upstream pair of rollers for introducing food by-products onto the lower conveyor. The first downstream pair of opposed rollers form between the upper and lower conveyors a gap of a first defined height. The upstream pair of opposed rollers form between the upper and lower conveyors a gap of a second defined height, wherein the first defined height is substantially less than second defined height. Planes of the opposed upper and lower conveyors define, between the upstream and downstream pairs of opposed rollers, a gradual tapered throat. The throat is for entry of food by-product within the input region and for controlled compression thereof between the conveyors within the throat to remove liquid therefrom as the drive mechanism rotates.

14 Claims, 3 Drawing Sheets

FOOD BY-PRODUCT PROCESSING APPARATUS

BACKGROUND OF THE INVENTION

The invention relates to food processing and more particularly to method and apparatus for processing food by-products produced, for example, by produce houses, restaurants, institutional kitchens, food processors, groceries and other businesses performing similar food processing activities.

When food is processed for consumption, there is waste. Groceries preparing produce for sale trim and cull the produce so that only the most desirable is displayed. Likewise with restaurants preparing food for eating. Stale produce from display shelves and leftover food from dining tables are removed, post-consumption, and are either disposed or recycled. These food by-products often have high water content, and their high density makes them difficult to handle and expensive to transport. Often, such food by-products are transported by truck to landfills. The trucks used in transportation are high-volume waste containers that have been designed for containment of relatively low-density materials. Thus, a truck transporting food by-products typically travels from waste pickup locations to landfills only partly full so as not to exceed the gross vehicle weight limits imposed by the trucking industry, motor vehicle division or transportation and interstate commerce departments.

U.S. Pat. No. 5,744,006 entitled APPARATUS FOR DEWATERING MIXTURES OF FIBROUS AND LIQUID MATERIALS issued Apr. 28, 1998 is illustrative of the prior art. That patent discloses an endless belt conveyor de-watering system having opposed rollers, the position of one of the rollers being manually adjustable to form a fixed pressure gap at the opposed rollers' point of tangency through which a continuous web of fibrous/liquid mixture is passed. U.S. Pat. No. 5,176,825 entitled SYSTEM FOR TREATING FOOD WASTE BY CENTRIFUGAL SPIN DRUM AND BAG FILTER issued Jan. 5, 1993 describes a food waste processing system. The food waste processing system features an apertured drum which is spun (as in the centrifugal rinse cycle for a washing machine) to remove water from material contained therein. U.S. Pat. No. 5,906,793 entitled PROCESS FOR THE DISPOSAL OF WET REFUSE issued May 25, 1999 describes a heating process for cooking and drying refuse. U.S. Pat. No. 5,924,217 entitled LIQUID REMOVAL CONVEYOR SYSTEM AND METHOD issued Jul. 20, 1999 describes a conveyor system including a liquid-permeable belt, an agitator for jostling the belt and the material traveling therealong, and a suction plenum for sucking the liquid through the belt.

SUMMARY OF THE INVENTION

Apparatus and improvements thereto are disclosed for processing food by-products. The apparatus in accordance with the invention includes a frame; an upstream and a first downstream pair of opposed rollers mounted for rotation within the frame, at least one of the rollers being rotated by a rotary drive mechanism. The apparatus further includes opposed upper and lower conveyors advanced between the upstream and first downstream pairs of opposed rollers as the rollers rotate, with the lower conveyor providing along opposite edges thereof for liquid run-off. The apparatus further includes an input region adjacent the upstream pair of rollers for introducing food by-products onto the lower conveyor. The first downstream pair of opposed rollers form between the upper and lower conveyors a gap of a first defined height. The upstream pair of opposed rollers form between the upper and lower conveyors a gap of a second defined height, wherein the first defined height is substantially less than second defined height. Planes of the opposed upper and lower conveyors define, between the upstream and downstream pairs of opposed rollers, a gradual tapered throat. The throat is for entry of food by-product within the input region and for controlled compression thereof between the conveyors within the throat to remove liquid therefrom as the drive mechanism rotates.

A first disclosed improvement includes the use of dual opposed pinch rollers between which dual opposed belt conveyors are advanced by rotation of the rollers by a drive mechanism. The rollers are generally cylindrical and have an outer generally cylindrical surface made of a resilient deformable material that temporarily yields to impingement through the belts by food by-product particulate as the particulate is advanced between the belts for processing.

A second disclosed improvement is for use in food-processing apparatus for transporting food particulate between successive food-processing stations. This second improvement includes a drive mechanism, and an elevator coupled with the drive mechanism, with the elevator including parallel opposed tensioned conveyor belts oriented at an approximately vertical angle to raise the elevation of the food particulate captured between the belts.

The foregoing and other objects, features and advantages of the invention will become more readily apparent from the following detailed description of a preferred embodiment which proceeds with reference to the drawings.

DETAILED DESCRIPTION OF THE PREFERRED EMBODIMENT

Figure 1:
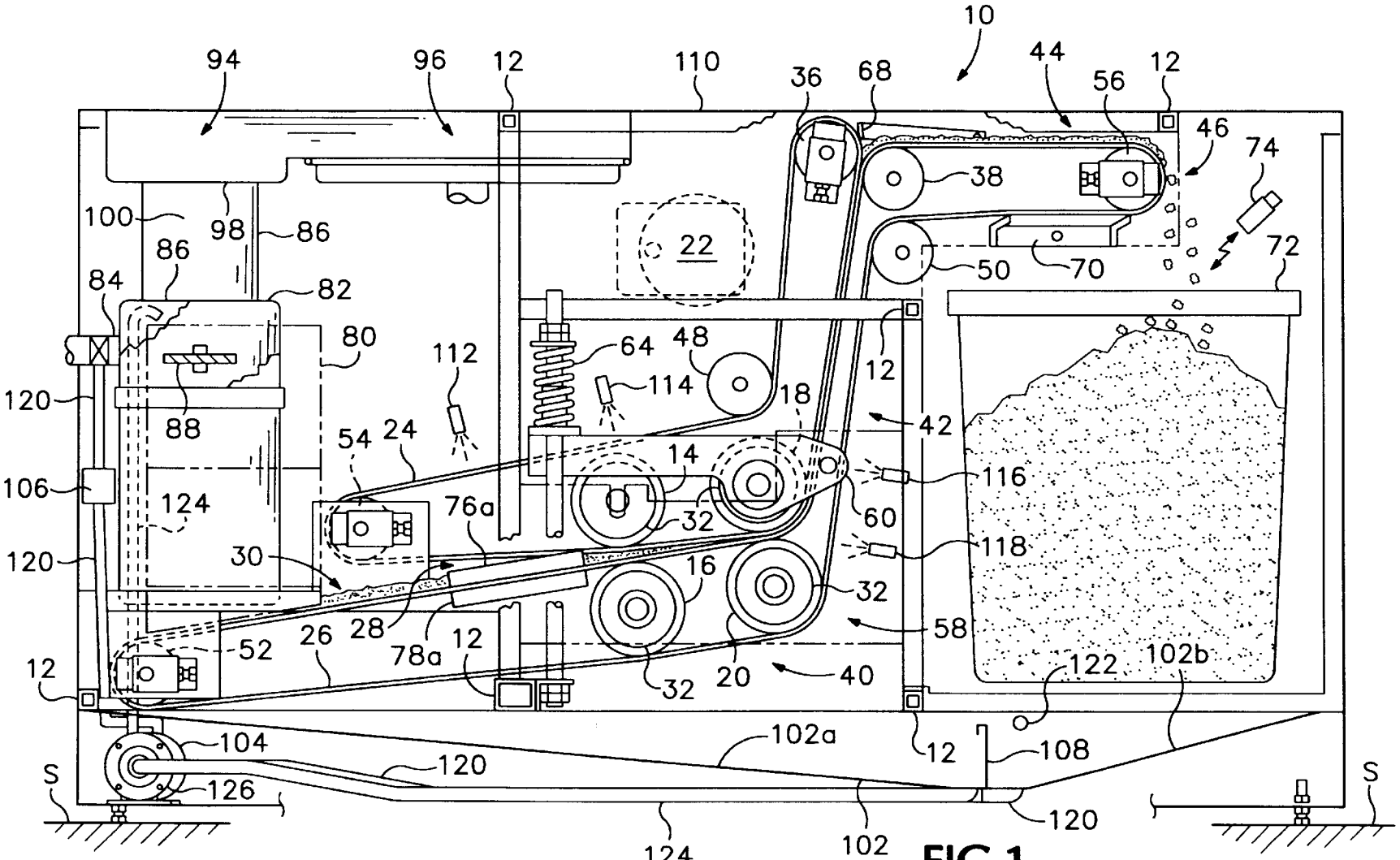
FIG. 1 is a front elevation of the apparatus in accordance with the invention.
Figure 2:
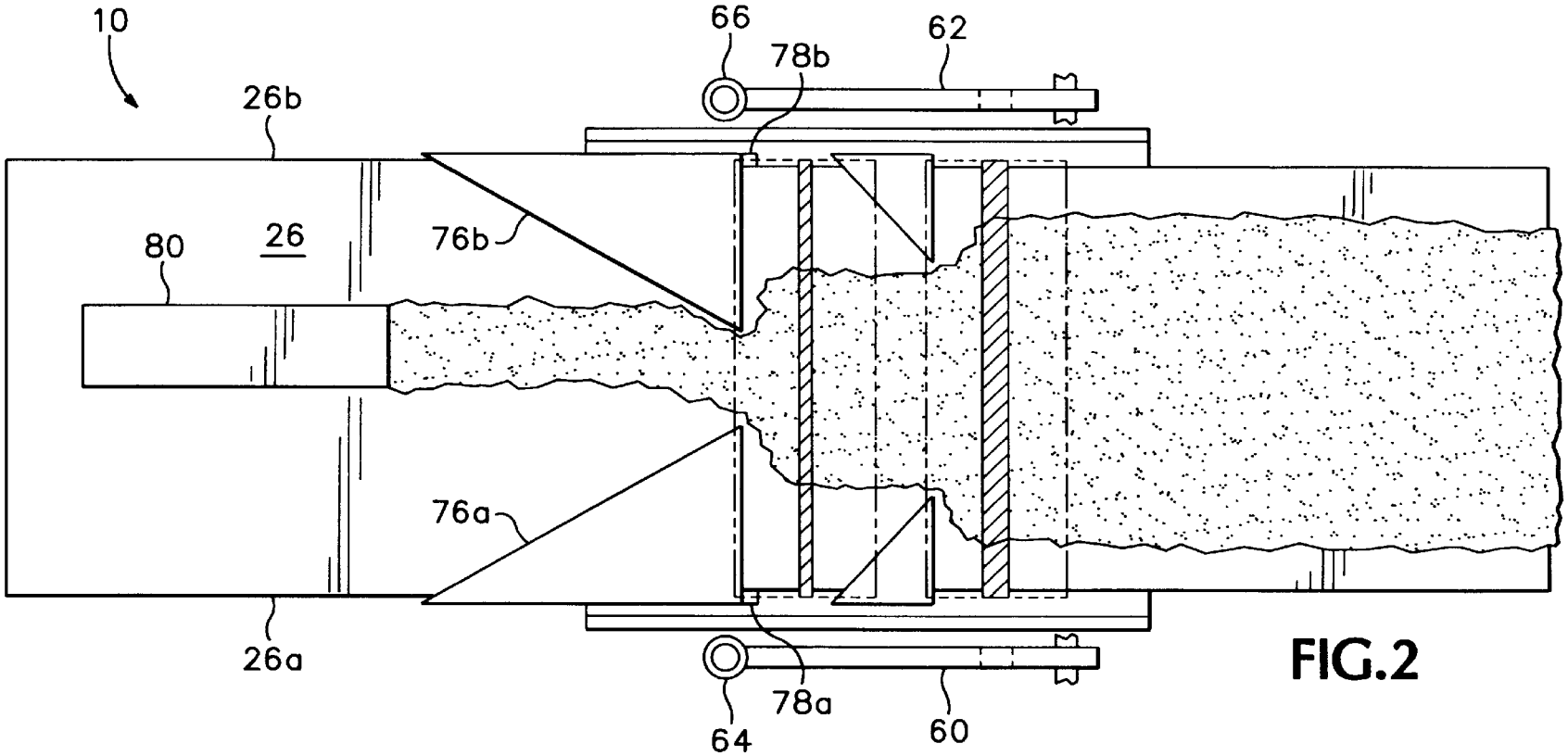
FIG. 2 is a simplified, somewhat schematic top plan view of the apparatus in accordance with the invention showing how food by-product is advanced along a conveyor in accordance with the invention.
Figure 3:
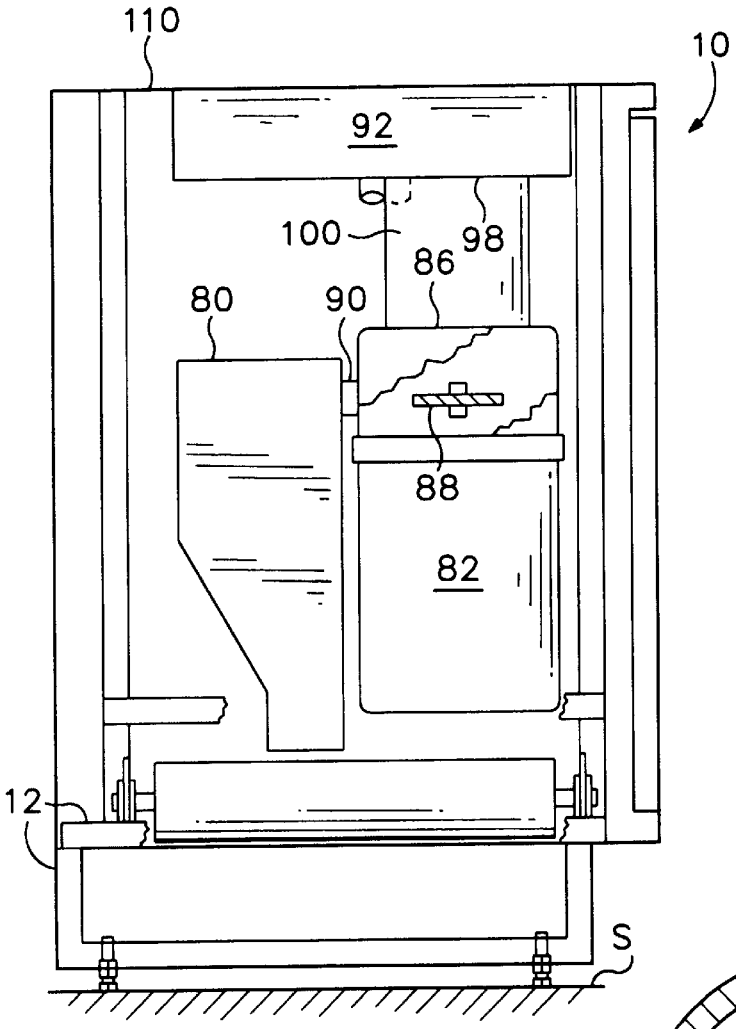
FIG. 3 is a side elevation of the apparatus in accordance with the invention.

FIGS. 1 through 3 show the food by-products processing apparatus in accordance with the invention at 10. Apparatus 10 includes a rectilinear frame 12, a welded square tubular, sheet metal and wood or particle board structure that may typically rest on a support surface S (by the use of the illustrated conventional threaded leveling structures, if desired) such as a floor in a restaurant or grocery. Those of skill also will appreciate that frame 12 as used herein refers to the infrastructure and superstructure that supports and houses the invented apparatus. It will be seen that the illustrations of frame 12 herein omit unnecessary detail for the sake of clearly illustrating the structure and advantages of the invention. For example, sheet metal walls and other structural components are omitted in some views, as is cabinetry of conventional design that preferably forms a part of the invented food by-product processing apparatus.

Apparatus 10 also includes an upstream pair of opposed rollers 14, 16 mounted for rotation within frame 12 and a first downstream pair of opposed rollers 18, 20 also mounted for rotation therein. Those of skill in the art will appreciate that upstream and downstream as used herein refer to the downstream direction of the flow of food by-products processed by apparatus 10, and are not intended to limit the invention's structure, function or operation to any particular elevation, orientation or direction. Those of skill in the art also will appreciate that 'wet' and 'dry' as may be used herein are relative terms that refer to the upstream and downstream food by-product before and after processing, respectively, in accordance with the invention.

At least one of rollers 14, 16, 18, 20 is rotated in accordance with the invention by a rotary drive mechanism 22 such as an electric motor. In accordance with the invention, roller 18 is driven and roller 20 is geared to roller 18, although any suitable drive train is within the spirit and scope of the invention. Those of skill will appreciate that any one or more of the rollers, within the spirit and scope of the invention, may be driven to impart rotation to the dual opposed roller pairs via conveyors to be described. Rollers 14, 16, 18, 20 are mounted for rotation on shafts that are relatively fixedly mounted in frame 12, as may be seen. Notably, roller 18 is mounted on a pivotal rocker arm, to be described, and roller is dropped into a keyhole insertion slot in frame 12 and then fixed or floated therein relative to the frame.

Apparatus 10 further includes opposed upper and lower conveyors 24, 26 advanced between the upstream pair of rollers 14, 16 and the downstream pair of rollers 18, 20 during rotation of the rollers. It will be appreciated that in accordance with the invention conveyors 24, 26 are continuous, or so-called endless, preferably cloth-reinforced rubber belts under tension and in frictional rolling engagement with the rollers. When the drive roller is driven by the rotary drive mechanism, conveyors 24, 26 advance through opposing closed-loop paths. Illustratively in FIG. 1, upper conveyor 24 advances in a counter-clockwise path and lower conveyor 26 advances in a clockwise path. One or more rollers may be driven, whether by separate rotary drive mechanisms or by belts, chains or gear trains (not shown for the sake of clarity, and preferably of conventional belt-and-sprocket design). The remaining rollers may be idle as they will be rotated by frictional engagement with the conveyor that they contact. The conveyors advance in parallel engagement between downstream rollers 18, 20 so that the rotational speed of conveyors 24, 26 is the same.

First downstream pair of opposed rollers 18, 20 form between upper and lower conveyors 24, 26 a gap of a first defined height. Upstream pair of opposed rollers 14, 16 form between upper and lower conveyors 24, 26 a gap of a second defined height. It may be seen from FIG. 1 that the first defined height, e.g. nominally 0-inch, is substantially less than the second defined height, e.g. between approximately ¼-inch and ½-inch. The gaps between opposed rollers 14, 16 and between opposed rollers 18, 20 define openings of different dimensions through which food by-product is made to pass. In accordance with the invention, the planes of the opposed upper and lower conveyors define between the upstream and downstream roller pairs a gradual tapered throat, indicated at 28.

Food by-product is introduced onto the lower conveyor via an input region 30 of apparatus 10 adjacent the upstream pair of rollers where upper and lower conveyors 24, 26 are gapped preferably between approximately 2-inches and 3-inches. It is urged in a graduated and controlled manner into a smaller and smaller volume by throat 28, thereby to reduce its liquid content, as drive mechanism 22 rotates rollers 14, 16, 18, 20 to advance conveyors 24, 26. The particulate food by-product (illustrated in FIGS. 1 and 2 by stippling) may be seen to be captured between upper and lower conveyors 24, 26. Meanwhile, liquid urged therefrom by controller compression of the food by-product flows outwardly from the center toward either side of the conveyors and runs off opposite lateral edges 26*a* and 26*b* of lower conveyor 26 (see FIG. 2).

Those of skill in the art will appreciate that the upstream and first downstream pairs of opposed rollers 14, 16, 18, 20 cooperate with upper and lower conveyors 24, 26 to advance and compress food by-product conveyed through throat 28 in a controlled two-phase manner. First, wet particulate between the conveyors in the region of opposed rollers 14, 16 is compressed to a first extent to remove some liquid or fluid therefrom. This first extent is predetermined by the gap between rollers 14, 16, and the resulting pressure on food by-product therein is preferably approximately 500 pounds. (This first compression extent is indicated by a first shaded band slightly left of center in FIG. 2.) Second, somewhat more dry particulate between the conveyors in the region of opposed rollers 18, 20 is compressed to a second extent to remove a large fraction (and preferably substantially all) of the remaining liquid therefrom. This second extent is predetermined by the gap between rollers 18, 20, and the resulting pressure on food by-product therein is preferably approximately 2000 pounds. (This second compression extent is indicated by a second shaded band slightly right of center in FIG. 2.)

Those of skill in the art will appreciate that there are tradeoffs involved in advancing food by-product through a pressure gradient. If the pressure is too high, particulate might not advance because it skids and/or jams. If the pressure is too low, particulate might retain too much fluid. It has been discovered that an excellent tradeoff is achieved by increasing the pressure in a controlled, preferably linearly tapered way, applied somewhat less forcefully between opposed conveyors 24, 26, somewhat more forcefully between opposed upstream rollers 14, 16 and most forcefully between opposed downstream rollers 18, 20.

It may be appreciated then that, unlike prior art apparatus, invented apparatus 10 does not rely on heaters, centrifuges, agitators or pumps to remove liquid from food by-product.

It has been discovered that tapered throat 28 helps form a controlled volume of food by-product advancing between upper and lower conveyors 24, 26. The angles of attack are believed to represent the important tradeoff described above. The angle subtended by upper and lower conveyors 24, 26 is preferably approximately 10° upstream of first upstream pair of rollers 14, 16 and preferably between approximately 3° and 5° between first upstream pair of rollers 14, 16 and first downstream pair of rollers 18, 20. These angles through which throat 28 is tapered are believed to 'draw' material downstream between high-pressure first downstream pair of rollers 18, 20 where most of the liquid-removal work is done. Such a draw maximizes liquid removal while avoiding jamming. The draw also avoids skidding along the conveyor of larger and more durable particulate and a resulting accumulation of material immediately upstream of rollers 18, 20, an undesirable 'snowplow' effect by which material curls back and away from the high-pressure roller pair instead of advancing therethrough.

Figure 4:
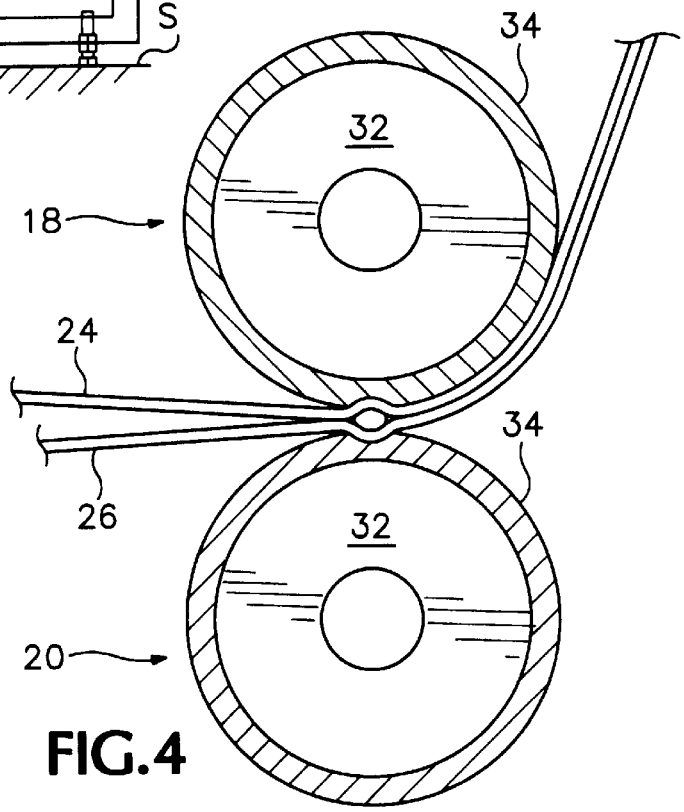
FIG. 4 is a fragmentary, cross-sectional front elevation showing in detail the rubber-surfaced rollers and belts that form a part of the food by-product processing apparatus' conveyance mechanism, in accordance with the invention.

Referring briefly to FIG. 4, the rollers and the conveyors will be described in some detail. In accordance with the invention, upper and lower conveyors are made of solid rubber, i.e. rubber expanses having no apertures, which has been demonstrated to provide the required flexible durability under tension. Also in accordance with the invention, rollers 14, 16, 18, 20 are hollow cylinders preferably made of steel that have conveyor-confronting outer surfaces also made of rubber. It is within the spirit and scope of the invention to make rollers 14, 16, 18, 20 out of solid rubber, e.g. polyurethane. It is believed preferable however to provide a hollow cylindrical steel roller 32 with an outer, preferably cast, layer 34 of approximately ½-inch thick rubber that controllably and temporarily yields, or resiliently deforms, in the presence of food particulate between conveyors 24, 26. The use of rubber in the engaging surfaces of rollers 14, 16, 18, 20 and conveyors 24, 26 provides the needed friction and malleability to advance the particulate downstream and provides the needed pressure to press liquid from the particulate. Preferably the material layer 34 is cast polyurethane of approximately D50 hardness, although any suitable material and hardness is within the spirit and scope of the invention.

In accordance with the invention, a second downstream pair of opposed rollers 36, 38 is provided, across which opposed upper and lower conveyors 24, 26 are advanced. It may be seen that third pair of rollers 36, 38 are in accordance with the invention elevated at a substantial height above the level of upstream pair of rollers 14, 16 and first downstream pair of rollers 18, 20. This first upstream pair of rollers 14, 16 and first downstream pair of rollers 18, 20 and upper and lower conveyors 24, 26 advancing therebetween will be referred to herein as a first generally horizontal run 40. The first downstream pair of rollers 18, 20 and second downstream pair of rollers 36, 38 and upper and lower conveyors 24, 26 advancing therebetween will be referred to herein as a generally vertical run 42. Generally vertical run 42 may be referred to herein as a processed food by-product elevator.

It may be appreciated that vertical run 42, including first and second downstream pairs of rollers 18, 20, 36, 38 and upper and lower conveyors 24, 26 advancing therebetween, elevates food by-product toward an output region of apparatus 10, as will now be described. A second generally horizontal run 44 downstream from generally vertical run 42 may be seen to include lower conveyor 26. Preferably, then, in accordance with the invention, food by-product as it is processed by apparatus 10 is conveyed downstream on lower conveyor 26 along first generally horizontal run 40, then along generally vertical run 42, and finally along second generally horizontal run 44. First horizontal run 40, vertical run 42 and second horizontal run 44 may be seen rather lazily to describe the letter 'S.' Thus, lower conveyor 26 as it is guided along rollers 18, 20, 38 will be described herein as being of a generally S configuration.

It is believed that a smooth opposed-belt conveyor mechanism such as that described herein is superior to conventional conveyor mechanisms including cleated and bucket-brigade conveyors which are far less efficient and far harder to clean.

The output region of apparatus 10 is indicated generally at 46 of FIG. 1. Dry particulate from which at least approximately two-thirds of the water by mass and volume has been removed is available in output region 46. This reduction typically is realized in accordance with the invention in the processing of pre-consumer food by-product (e.g. from groceries). Considerably greater water mass and volume reduction than two-thirds typically is realized in accordance with the invention in the processing of post-consumer food by-product (e.g. from kitchens). Those of skill in the art will appreciate that the processed food by-product's density (the ratio of mass to volume) would remain constant as a result of proportionate reductions in mass and volume of the processed food by-product from which most water is removed. Those of skill in the art will appreciate that the reduction in mass and volume are dependent upon a number of factors. These include the original water content of the food by-product (which depends in turn on its composition) and the amount of water added during the process (e.g. the volume of water inputted to pulverizer 82).

In any event, the reduction in mass and volume renders the processed food by-product much easier to lift and transport. This great advantage of the invention encourages proper recycling or reuse, e.g. as compost, mulch, livestock feed, etc.

It may be seen that apparatus 10 in accordance with the invention includes a number of idle or guide rollers, including three fixed-position guide rollers 38, 48, 50 and four adjustable-position guide rollers 36, 52, 54, 56. All of guide rollers 36, 38, 48, 50, 52, 54, 56 are frame mounted for rotation with conveyors 24, 26 and fix the complex rotational path thereof through apparatus 10. The guide rollers preferably are made of plastic, e.g. ultra-high molecular weight (UHMW) polyethylene, although within the spirit and scope of the invention they may be made of any suitable material that is compatible with frictional engagement with the surface of a rubber belt. Adjustable-position guide rollers 36, 52, 54, 56 will be understood to be tensioning rollers that are manually adjustable to adjust the tension of conveyors 24, 26. Those of skill in the art will appreciate that one or more of adjustable-position guide rollers 36, 52, 54, 56 typically may be slightly crowned along their lateral extent to ensure proper tracking of conveyors 24, 26 therearound, as is known.

Those of skill in the art will appreciate that in accordance with the invention rollers 14, 16, 18, 20, 36, 38, 48, 50, 52, 54, 56 are mounted for rotation on shafts captured within ball bearing assemblies (not shown). Any suitable bearing arrangement compatible with the durability and speed required efficiently to process food by-product is contemplated and is within the spirit and scope of the invention.

Opposing pairs of rollers 14, 16, 18, 20, 36, 38, guide rollers 36, 38, 48, 50, 52, 54, 56, and conveyors 24, 26 will be referred to herein as a conveyor mechanism, indicated generally at 58.

Another aspect of conveyor mechanism 58 is the pivotal mounting of upper roller 18 on dual frame-mounted rocker arms 60, 62 (See FIGS. 1 and 2). Upper roller 18 is urged downwardly into engagement with lower roller 20 preferably by dual coil springs 64, 66 (see FIGS. 1 and 2) to provide a predefined quantum of downward force on roller 20. Rocker arms 60, 62 will be understood to be mounted for pivoting in accordance with the invention within simple bushings, although of course any suitable mounting for pivotal rotation is contemplated. Such downward force establishes a yielding amount of pressure between first downstream pair of rollers 18, 20 on conveyors 24, 26 advancing therebetween. The use of one or more springs or other suitable means of urging roller 20 toward opposing roller 18 enables conveyors 24, 26 between rollers 18, 20 to open in a controlled manner when a relatively large, unyielding particulate is captured between the conveyors and conveyed between the rollers. In other words, the high-pressure gap between opposed pair of rollers 18, 20 may increase momentarily to permit passage rather than blockage of large or dense particulate, but normally is maintained at its nominal zero-height and 2000 pound force.

FIG. 1 perhaps best illustrates two further features of apparatus 10 in accordance with the invention. One or more belt scrapers such as upper belt scraper 68 and dual lower belt scraper 70 are provided. It will be understood that belt scrapers 68 and 70 are edge-sharpened metal blades that extend laterally along the substantial lateral width of upper and lower conveyors 24 and 26, respectively. Belt scrapers 68, 70 are frame mounted with their sharpened edges in close proximity to the nominal moving surface of the respective belts and remove sticky particulate therefrom prior to the return upstream transit of the endless belts. Apparatus 10 also includes a solids container 72 and level switch 74 connected therewith for indicating to a user when the solids container 72 is full of dry particulate and ready to empty. Level switch 74 is shown schematically and may be of conventional design, e.g. electro-optic.

Solids container 72 preferably is at least of 25-gallon capacity. Importantly, a relatively large solids container 72 may be used in connection with apparatus 10 because of the relatively low mass of the dry food by-product particulate that exits output region 46 of the apparatus. The mass of the dry particulate exiting output region 46 and entering solids container 72 is relatively low as a result of the normal operation of conveyance mechanism 58 in accordance with the invention. Frame 12 of apparatus 10 preferably includes a convenient set of double doors in the front—one for removal of solids container 72 when it is full and one for access to conveyor mechanism 58 and other components of apparatus 10 for inspection, maintenance or manual cleaning thereof.

Referring briefly to FIGS. 1 and 2, it may be seen that apparatus 10 preferably includes at least two belt wipers, or guide structures, 76*a*, 76*b* and 78*a*, 78*b*, positioned respectively above and below lower conveyor 26 generally within tapered throat 28. Wipers 76*a*, 76*b* oppose uncontrolled outward lateral migration of food by-product on the upper surface of lower conveyor 26. Wipers 76*a*, 76*b*, 78*a*, 78*b* preferably are made of plastic, e.g. UHMW polyethylene, and are triangular in shape. Upstream inwardly inclined faces of wipers 76*a*, 76*b* are generally coplanar with the upper surface of lower conveyor edges 26*a*, 26*b*. These faces corral the food by-product and guide it along lower conveyor 26. Complementary faces of guide structures 78*a*, 78*b*, are generally coplanar with the lower surface of conveyor 26. These complementary faces prevent incidental downward deflection of lower conveyor edges 26*a*, 26*b*.

Wipers 76*a*, 76*b* preferably are positioned and oriented within throat 28 to guide, and to restrict migration of, food by-product within a fractional lateral extent of the lower conveyor, as shown in the top plan view of FIG. 2. This ensures that upstream pair of opposed rollers 14, 16 and downstream pair of opposed rollers 18, 20 are effective in urging liquid therefrom without permitting more than a tiny amount of food by-product to reach either edge of the belt. It also ensures that the food by-product is optimally spread laterally across lower conveyor 26 and between upper and lower conveyors 24, 26 as it is compressed in stages between upstream pair of rollers 14, 16 and downstream pair of rollers 18, 20. FIG. 2 illustrates the beneficial effect of wipers 76*a*, 76*b* by their inward downstream incline and mirrored lateral opposition.

Those of skill in the art will appreciate that multiple pairs of such belt wipers or alternative food by-product and belt conveyor guide structures may be provided in apparatus 10, within the spirit and scope of the invention. Those of skill also will appreciate that gutters may be provided on either side of lower conveyor 26 to guide the water urged from processed food by-product into a catch pan to be described.

FIGS. 1 and 3 best illustrate further aspects of the invention. Apparatus 10 in accordance with the invention further includes a preferably stainless steel surge hopper 80 for temporary storage of food by-product particulate exiting a food pulverizer 82. Food pulverizer 82 will be understood to be similar to most industrial strength garbage disposals, with a water inlet 84 for lubrication and a food inlet 86. Finally, food pulverizer 82 includes a head, or a set of conventionally powered high-speed rotary blades 88 (shown only in fragmentary part) for reducing food by-product entering the food inlet to particulate exiting a food outlet 90. FIG. 1 best shows that pulverized food by-product exiting food outlet 90 of food pulverizer 82 enters surge hopper 80 via any suitable conduit.

Upstream from food pulverizer 82, and preferably immediately thereabove, apparatus 10 includes a sink 92. Sink 92 provides a user of apparatus 10 with a convenient area to discard food by-product for processing thereof in accordance with the invention. It may be seen from FIG. 1 that sink 92 preferably is subdivided into two sections: a disposal/recycling section 94 and a standard rinse section 96 including a source of water such as a faucet and a drain (neither of which conventional components is shown). Disposal/recycling section 94 of sink 92 has an outlet 98 coupled with food inlet 86 of food pulverizer 82 by a suitable conduit 100. Those of skill in the art will appreciate that sink 92 may take any suitable form compatible with the introduction into conveyor mechanism 58 of food by-product for processing in accordance with the invention.

Those of skill in the art also will appreciate that apparatus 10 may be operatively coupled with further upstream or downstream stations whereby, for example, food preparation including culling takes place or processed food by-product is recycled or disposed, respectively. Those of skill also will appreciate that sink 92, pulverizer 82, surge hopper 80, and other components of apparatus 10 within the spirit and scope of the invention may be separately frame mounted. For example, such may form a part of another station upstream from the station components shown herein as being housed within frame 12 as an integral part of apparatus 10.

A catch pan 102 is provided within frame 12 below conveyor mechanism 58 to capture for reuse water that runs off lower conveyor 26. Such captured so-called gray water may be recirculated for reuse in food pulverizer 82 to save water. For example, gray water may be returned to pulverizer 82 via a pump 104, a filter 106 and a valve (shown schematically in FIG. 1 as an X) within inlet 84 of food pulverizer 82. Preferably, catch pan 102 has inwardly downwardly inclined opposing surfaces in the form of a V, as best shown in FIG. 1. Near the apex of the V, it may be seen that catch pan 102 preferably includes a dam, or dam structure, 108 that extends laterally to divide catch pan 102 into two sections. An upstream section 102*a* of the catch pan provides for containment of gray water that may carry some particulate in suspension. A downstream section 102*b* of the catch pan provides for containment of gray water flowing over dam 108 that is clean enough for reuse by food pulverizer 82 or for cleaning of apparatus 10, as will be seen.

Importantly, the gray water that accumulates in downstream section 102*b* of catch pan 102 typically has a relatively low concentration of food by-product. This is a virtue of the unique dam that subdivides the catch pan and that obstructs relatively dense food by-product particulate (which tends to settle rather than float) from entering the cleaner gray water section. Gray water from section 102*b* of catch pan 102 (perhaps with the addition of a filter) typically is so clean that it may enter sewage facilities without the heavy toll that regulatory and taxing authorities often charge disposal of dirtier gray water having high suspended particle concentrations. So, even if the gray water is not recycled for reuse within apparatus 10 in accordance with the preferred method, nevertheless it may be discharged to a drain at lower overall cost to the facility and the environment.

It is also apparent that far less gray water accumulates within catch pan 102 by virtue of the controlled addition of water at an extremely low volume to the processing of food by-products within pulverizer 82. Controlled in-flow of water to the pulverizer is facilitated by subdividing sink 92 and providing for the advantageously separated rinse and disposal functions.

Thus, less clean water is used by the invented apparatus than by conventional systems and less dirty water is produced by the invented apparatus than by conventional systems. Clean water is saved; the environment is protected.

Sink 92 will be understood by those of skill in the art to be preferably approximately waist high, which desirable feature is realized in apparatus 10 by the illustrated configuration of the conveyor mechanism. Thus, in accordance with the invention frame 12 is dimensioned in height so as to mount sink 92 flush with a preferably level top work surface 110 of apparatus 10. Those of skill in the art will appreciate that this waist-high height advantage is achieved in accordance with the invention by configuring conveyor mechanism 58 compactly and preferably in accordance with the invention described and illustrated herein. The width and depth of frame 12 also preferably are minimized in accordance with the invention to reduce the so-called footprint of apparatus 10 and to make facility layout and planning compatible with facilities planning floor layout and cost goals of produce houses, restaurants, institutional kitchens, food processors, groceries, and the like.

One or more pairs of opposing spray nozzles preferably are included in apparatus 10 for semi-automatic or fully automatic cleaning purposes. An upper pair of nozzles 112, 114 preferably are directed toward the outer surface of upper conveyor 24 on its return path upstream. Similarly, a lower pair of nozzles 116, 118 preferably are directed toward the outer surface of lower conveyor 26 on its return path upstream. Those of skill in the art will appreciate that the nozzles may be frame mounted in an advantageous position for cleaning the conveyors and/or other interior regions of apparatus 10. Such may be done by charging them with fluid, e.g. water, under pressure from a suitable source, whether under manual control of the user or under the automatic, periodic control of a conventionally programmed logic controller (PLC) not shown. Programmed periodic cleaning, opening of valves, reading of level sensors, etc. are well within the level of skill of the artisan and are not described in detail herein.

Those of skill in the art will appreciate that gray water caught in catch pan 102 may be used in operation of apparatus 10. For example, cleaner gray water from section 102*b* thereof may be routed via a liquid conduit 120 to water inlet 84 of pulverizer 82. Such conduit may pass through pump 104 and filter 106. Alternatively, tap water from an external source may be introduced into pulverizer 82 via a solenoid valve activated by a photo sensor so that optimal pulverizing or grounding of the food by-product is achieved without excess water. It is believed that food by-product is optimally ground in pulverizer by adding approximately 10-milliliters (ml) of water per pound of food by-product. Thus, far less water is used by apparatus in connection with processing food by-product than is conventional. This produces a further saving of water, whether of clean water or gray water.

Similarly, gray water from catch pan 102 may be used to charge a liquid reservoir (not shown) that powers spray nozzles 112, 114, 116, 118. Such gray water may pass through a separate pump and a filter, if desired, or it may come from the same illustrated gray water source used by food pulverizer 82. Those of skill will appreciate that alternative sources of water such as clean tap water may be used for cleaning and/or pulverizing purposes. In that case, gray water may be recycled preferably from the cleaner downstream section 102*b* of catch pan 102 for reuse within a water reclamation facility that is proximate to or remote from invented apparatus 10. An overflow drain 122 may be provided in catch pan 102 for such purpose. Those of skill also will appreciate that drainage from rinse sink 96 may be provided, as is conventional, and that catch pan 102 and rinse sink 96 may share a so-called p-tube and/or facilities drain conduit (not shown).

One important final feature of apparatus 10 may be seen best from FIG. 1. Dirtier gray water from upstream section 102*a* of catch pan 102 preferably is returned to surge hopper 80 for recycling within apparatus 10 itself. Such gray water may be laden with a relatively high level of food particulate that may benefit from re-processing. Thus, in accordance with the invention, a second return conduit 124 and a second pump 126 return heavy wet material from the bottom of catch pan 102 upstream to be input once again to surge hopper 82, as shown. Thus, it will be appreciated that apparatus 10 represents a relatively closed system that in many ways is easy on the environment.

The invention may be understood by those of skill in the art to represent a significant improvement in food-processing apparatus for transporting food particulate between successive food-processing stations. The improvement may be seen to include a drive mechanism, and an elevator coupled with said drive mechanism, the elevator including parallel opposed tensioned conveyor belts oriented at an approximately vertical angle to raise the elevation of the food particulate captured between the belts. The drive mechanism may be in accordance with rotary drive mechanism 22 and the elevator coupled therewith in accordance with the invention as described in connection with generally vertical run 42 of conveyor mechanism 58. Those of skill in the art will appreciate that such an elevator may find utility in other than the particular food by-product processing apparatus illustrated and described herein, since it may be used to elevate food particulate in a variety of contexts that require the particulate to be elevated.

The invention also may be understood to represent a significant improvement in food by-product processing apparatus having dual opposed belt conveyors, e.g. upper and lower conveyors 24, 26, and a drive mechanism, e.g. rotary drive mechanism 22. The improvement includes dual opposed pinch rollers, e.g. rollers 18, 20, between which the dual opposed belt conveyors are advanced by rotation of said rollers by the drive mechanism. Preferably, the rollers are generally cylindrical and have an outer generally cylindrical surface made of a resilient deformable material. The material temporarily yields to impingement through the belts by food by-product particulate as the particulate is advanced between the belts for processing. As described and illustrated herein, preferably the deformable material is rubber and, most preferably, the rollers have generally cylindrical metal walls and ends and the rubber is a polyurethane layer extending around said metal walls.

FIG. 4 shows in fragmentary detail the way in which the rubberized outer surfaces of opposed rollers 18, 20 temporarily deform to advantage when a large and/or dense particulate impinges on upper and lower conveyors 24, 26 extending therebetween. It may be seen from FIG. 4 that the rubber belts of conveyors 24, 26 each yields some of its nominal ¼-inch thickness, which yield alone might be insufficient to permit passage of the large particulate captured therebetween. Advantageously, however, the polyurethane surfaces of rollers 18, 20 each also yield a fraction of their ½-inch thickness. The result is that the large particulate is permitted to pass along the conveyors between the rollers. Nevertheless, the pressure between rollers 18, 20 is substantially undiminished and thus liquid is urged from the particulate material along the linear extent of the nominal zero-inch gap therebetween.

Having illustrated and described the principles of our invention in a preferred embodiment thereof, it should be readily apparent to those skilled in the art that the invention can be modified in arrangement and detail without departing from such principles. We claim all modifications coming within the spirit and scope of the accompanying claims.

What is claimed is:

1. Apparatus for processing food by-products, the apparatus comprising:

a frame;

an upstream and a first downstream pair of opposed rollers mounted for rotation within said frame, at least one of said rollers being rotated by a rotary drive mechanism;

opposed upper and lower conveyors advanced between said upstream and first downstream pairs of opposed rollers as said rollers rotate, said lower conveyor providing along opposite edges thereof for liquid run-off;

an input region adjacent said upstream pair of rollers for introducing food by-products onto said lower conveyor;

said first downstream pair of opposed rollers forming between said upper and lower conveyors a gap of a first defined height, said upstream pair of opposed rollers forming between said upper and lower conveyors a gap of a second defined height, said first defined height being substantially less than said second defined height, planes of said opposed upper and lower conveyors defining between said upstream and downstream pairs of opposed rollers a gradual tapered throat for entry of food by-product within said input region and for controlled compression thereof between said conveyors within said throat to remove liquid therefrom as the drive mechanism rotates.

2. The apparatus of claim 1 wherein said upper and lower conveyors are rubber and wherein at least one of said opposed rollers of at least said first downstream pair of rollers each includes a substantially cylindrical outer surface made of resilient deformable material, said outer surface confronting said upper and lower conveyors and temporarily deforming under the force of impingement on said upper and lower conveyors of food by-product.

3. The apparatus of claim 2, wherein said material is polyurethane.

4. The apparatus of claim 3, wherein said roller is a metal drum and wherein said polyurethane material is cast as an outer layer thereover.

5. The apparatus of claim 1 further comprising a second downstream pair of opposed rollers across which said opposed upper and lower conveyors also are advanced, said second downstream pair of opposed rollers forming between said upper and lower conveyors a gap of substantially said second defined height, said second downstream pair of opposed rollers being elevated above the level of said first downstream pair of opposed rollers, said upper and lower conveyors between said first and said second downstream pair of opposed rollers elevating the food by-product between said upper and lower conveyor toward an output region of the apparatus.

6. The apparatus of claim 5, wherein said upper and lower conveyors between said upstream and said first downstream pair of rollers extend generally horizontally and wherein said upper and lower conveyors between said first and second downstream pairs of rollers extend generally vertically.

7. The apparatus of claim 1 wherein one of said first downstream rollers is mounted for rotation on a pivot arm that is frame mounted, said pivot arm being biased by a spring to urge said pivot arm-mounted roller toward said opposed first downstream roller.

8. The apparatus of claim 7 further comprising a processed food by-products catch container mounted within said frame for containing processed food by-products entering said output region.

9. The apparatus of claim 8 wherein said upper and lower conveyors are continuous belts, said apparatus further comprising one or more frame-mounted scrapers confronting said belts adjacent said output region to remove processed food by-product from said belts.

10. The apparatus of claim 8 further comprising a plurality of frame-mounted spray nozzles and a source of compressed liquid for spraying therefrom to clean said conveyors.

11. The apparatus of claim 8 wherein said catch pan is equipped with a dam structure for separating liquid for reuse from food by-product that may be suspended in the liquid run off from said lower conveyor.

12. The apparatus of claim 11 further comprising a surge hopper mounted within said frame and coupled with said outlet of said pulverizer, said surge hopper positioned above said lower conveyer in said input region of said apparatus, said surge hopper regulating the rate of introduction of pulverized food by-product onto said lower conveyor.

13. The apparatus of claim 1 further comprising a food by-product pulverizer mounted within said frame, an outlet of said pulverizer directing pulverized food by-product toward said input region of said apparatus, said pulverizer having a liquid inlet directing liquid onto a head configured for pulverizing food by-product, said apparatus further comprising a liquid catch pan mounted within the frame beneath said lower conveyor, said catch pan extending at least as wide as the conveyor and at least as long as the extent of said lower conveyor between said upstream and said first downstream rollers, said catch pan capturing liquid from the edges of said lower conveyor, said apparatus further comprising a liquid conduit directing liquid from said catch pan to said inlet for reuse thereof.

14. The apparatus of claim 1 further comprising at least one pair of laterally opposed belt wipers mounted within said frame and positioned within said throat for restricting migration of the food by-product to within a predefined fractional lateral extent of said lower conveyor.

* * * * *